United States Patent [19]

Witty

[11] 4,408,949

[45] Oct. 11, 1983

[54] MECHANICAL DIGGER

[75] Inventor: Brian H. Witty, Kettering, England

[73] Assignee: Mantis Excavators, Ltd., Corby, England

[21] Appl. No.: 407,125

[22] Filed: Aug. 11, 1982

[30] Foreign Application Priority Data

Sep. 15, 1981 [GB] United Kingdom ..... 8127880

[51] Int. Cl.[3] ..... E02F 3/32

[52] U.S. Cl. ..... 414/694; 180/8 BA; 280/43.23

[58] Field of Search ..... 414/694; 212/189; 280/43.23, 43.24, 764, 755; 180/8.4

[56] References Cited

U.S. PATENT DOCUMENTS

| | | | |
|---|---|---|---|
| 2,781,927 | 2/1957 | Holopainen | 414/694 |
| 3,351,221 | 11/1967 | Smalley | 414/694 |
| 3,433,374 | 3/1969 | Menzi | 414/694 |
| 3,534,877 | 10/1970 | Menzi | 414/694 |
| 3,635,364 | 1/1972 | Tingleff | 414/694 |
| 3,638,961 | 2/1972 | Larsen | 280/755 |
| 3,989,149 | 11/1976 | Smith et al. | 414/694 |

*Primary Examiner*—Joseph E. Valenza
*Assistant Examiner*—Terrance L. Siemens
*Attorney, Agent, or Firm*—Poms, Smith, Lande & Rose

[57] ABSTRACT

A mechanical digger comprises a wheel-supported frame, an hydraulically operated digging device mounted on the frame, an engine mounted on the frame and arranged to operate the digging device and a seat arranged on the frame to allow the operator to view and to control the operation of the digging device; the frame is also provided with two wheel mounting locations at either of which a set of wheels can be replaceably mounted. Preferably, the frame is provided with an intermediate mounting location which is capable of mounting replaceably a rear set of ground engaging feet and the front location is capable of mounting replaceably a set of ground engaging feet or the wheel set.

26 Claims, 8 Drawing Figures

MECHANICAL DIGGER

FIELD OF INVENTION

This invention relates to a mechanical digger comprising a wheel supported frame, an hydraulically operated digging device mounted on the frame with an engine mounted thereon and arranged to operate the digging device, and a seat positioned to allow an operator to view and to control the operation of the digging device.

PRIOR ART

The invention has been developed primarily, though not exclusively, in relation to a relatively small scale digger i.e. a digger which is not sufficiently larger to justify the expense of providing its own motive power for transport purposes, so that a separate vehicle is required to transport the digger from place to place.

One small scale digger of the above type has been proposed, which comprises a wheel supported frame, an hydraulically operated digging device mounted at one end of the frame and having a ram-operated digger bucket provided at one end of the boom arrangement (known as a back-acter), a body mounted on the frame, and a seat arranged on the body so that an operator can sit with the legs astride the body and view and control the operation of the digger bucket. The frame is provided with round-engaging feet at each end of the frame which can support the frame with the wheels out of conact with the ground during digging operations. The wheels are fixedly mounted on the frame 8to provide a wheel base of less than 1 meter) at a position intermediate the front and rear ends of the frame i.e. intermediate the front and rear ground enaging feet, and serve to enable the digger to be manoeuvred when the feet have been removed or moved out of contact with the ground.

In order to manoeuvre the digger, it is necessary to remove the rear feet from engagement with the ground, and then to operate the digger bucket to engage the ground (1) so as to pivot the frame and raise the front end of the frame, and therefore the front feet, and (2) by pivotting the bucket and applying a force tending to close the distance between the bucket and the front end of the frame, the digger can be advanced towards the bucket (which is temporarily anchored to the ground). the bucket can then be advanced relative to the frame, and the process repeated in order further to advance the digger. Bearing in mind that the wheel base of the digger is very small compared with the overall length of the digger (with the bucket extended), this is a relatively unstable arrangement which is liable to topple sideways during forward movement of the digger and particularly, as may often be the case, if one of the wheels encounters an obstacle which will cause that side of theframe to be lifted up as the digger advances.

Furthermore, this is the only means whereby the digger may be manoeuvred under power and the construction of the digger is such that it does not readily lend itself to manual propulsion.

SUMMARY OF THE INVENTION

According to the invention there is provided a mechanical digger comprising a wheel-supported frame, an hydraulically operated digging device mounted on the frame, an engine mounted on the frame and arranged to operate the digging device, and a seat arranged on the frame to allow the operator to view and to control the operation of the digging device and wherein the frame is provided with two wheel mounting locations at either of which a set of wheels can be replaceably mounted.

One of the wheel mounting locations may be provided adjacent to the mounting of the digging device on the frame so that, when the wheel set is mounted at the location, the digger can be readily towed by a towing vehicle when the frame is coupled thereto. Coveniently, a draw bar is provided which is preferably detachably mounted on the frame, to enable the digger to be coupled-up with the towing vehicle. When the digging device is moved to a transport position, the arrangement is preferably such that the centre of gravity of the entire digger is closed to or at the wheel location so as to render the digger suitable for towing by a vehicle or movement of the digger by hand.

Conveniently, the digging device is mounted at a forward end of the frame and takes the form of a "back-acter" and the digger may be operated in a digging mode (with the wheel set moiunted adjacent thereto), while the opposite end of the frame remains coupled with a towing vehicle. However, if the digger is uncoupled from the towing vehicle, the wheel set may be removed from said one location (which serves for the transit mode and one digging mode of the digger) to the other location which serves as a further digging mode of the digger.

It is preferred that the frame is provided with three sets of substantially identical mounting locations provided at the front, rear and an intermediate position. The front location is capable of mounting replaceably a set of front engaging feet, or the wheel set, and the rear location is capable of mounting replaceably the wheel set. The intermediate location is capable of mounting replaceably a rear set of ground engaging feet. To improve firm engagement with the ground, the front and rear feet may be provided with "spades" which can dig into the ground surface.

The rear mounting location is preferably provided on a frame portion which is pivotally connected to the remainder of the frame for adjustment, preferably by means of a ram, about an axis parallel to the axis of the wheel set. When the wheel set is mounted at the rear location, this provides a counter balancing force to the effect of the digging device at the front end of the frame. The wheel set may be adjusted to remain out of contact with the ground, in which case the ground support for the rear end of the frame will be provided solely by means of the rear feet at the intermediate location. However, if increased rear ground support is required to alter the position of the mounting of the digging device relative to the ground, then the wheel set may be moved downwardly into contact with the ground.

In order to provide lateral stability to the digger, the front feet may extend both forwardly and laterally outwardly of the frame. Further, the wheels of the wheel set may each be mounted on a projecting stub, which is received by a respective mounting location, so that the wheel based is considerably greater than the lateral dimensions of the frame, for example up to twice the width of the frame.

In an embodiment of the invention, the following advantages are obtainable:

1. The digger is readily transportable by being coupled-up to a towing vehicle when the front and rear feet have been removed and the wheel set is at the front mounting location.

2. The digger can be operated in a digging mode while still coupled with a towing vehicle.

3. The digger can be operated in a further digging mode when the digger is uncoupled from the towing vehicle and the wheel set is moved to he rear mounting location.

4. The digger has lateral stability via the lateral spread of the front feet which can be detached during transport.

5. The digger has lateral stability via the wide wheel base provided by the wheel set; also the wheel set is detachable in order to reduce the lateral extent of the digger, for any purposes which may be required.

BRIEF DESCRIPTION OF THE DRAWINGS

One embodiment of a mechanical digger according to the invention will now be described in detail, by way of example only, with reference to the accompanying drawings in which.

DESCRIPTION OF A PREFERRED EMBODIMENT

Figure 1:
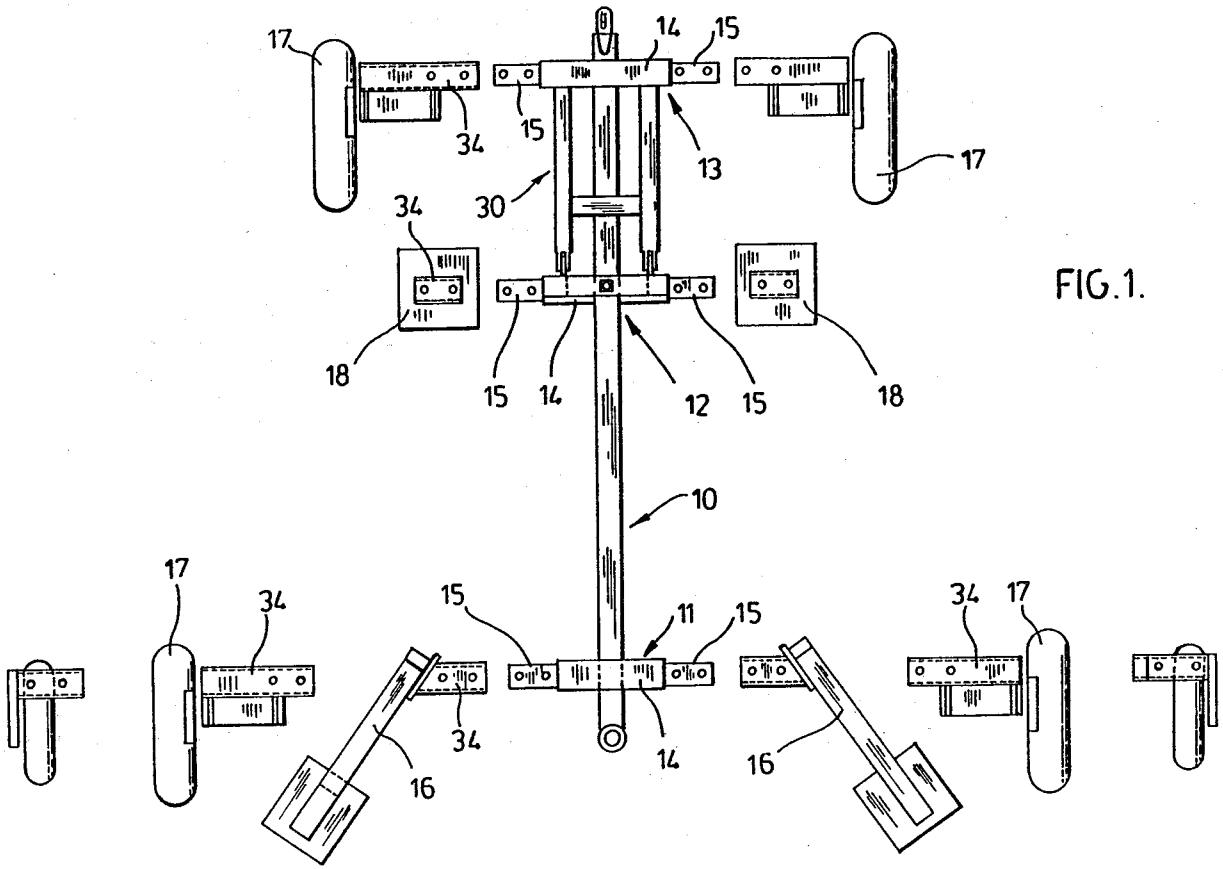
FIG. 1 is a schematic plan view of the mechanical digger.
Figure 2:
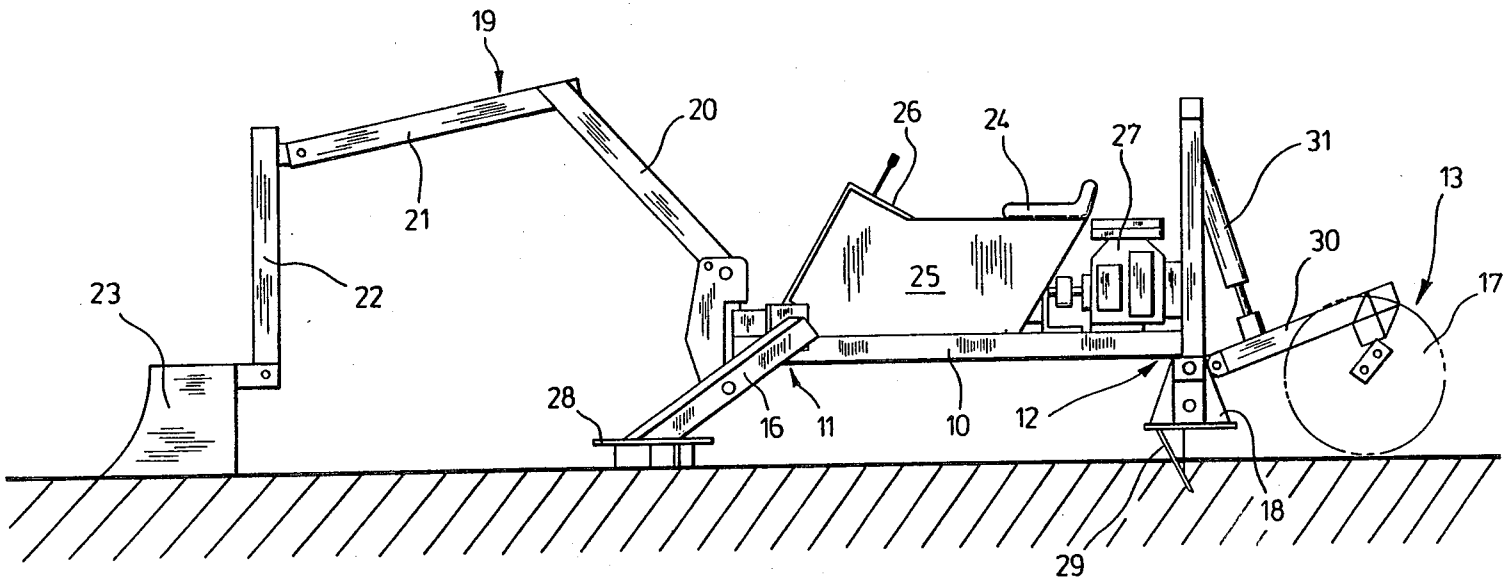
FIG. 2 is a side view of the digger, with an attached back-acter, in one digging mode.
Figure 3:
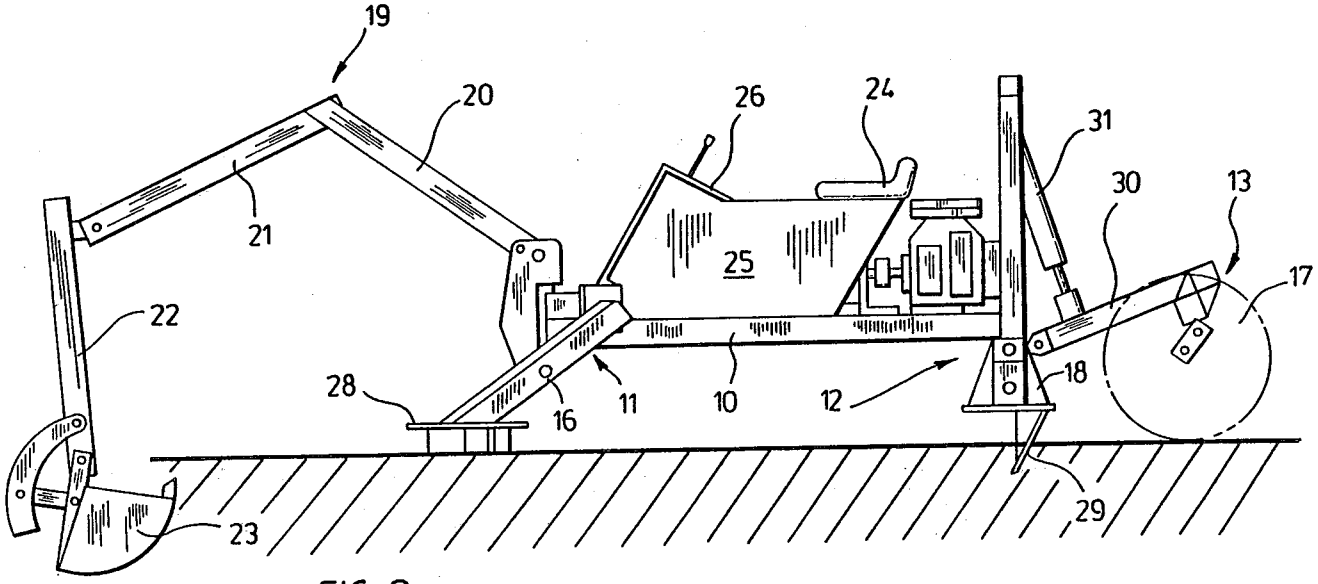
FIG. 3 is a side view of the digger in a further digging mode.
Figure 4:
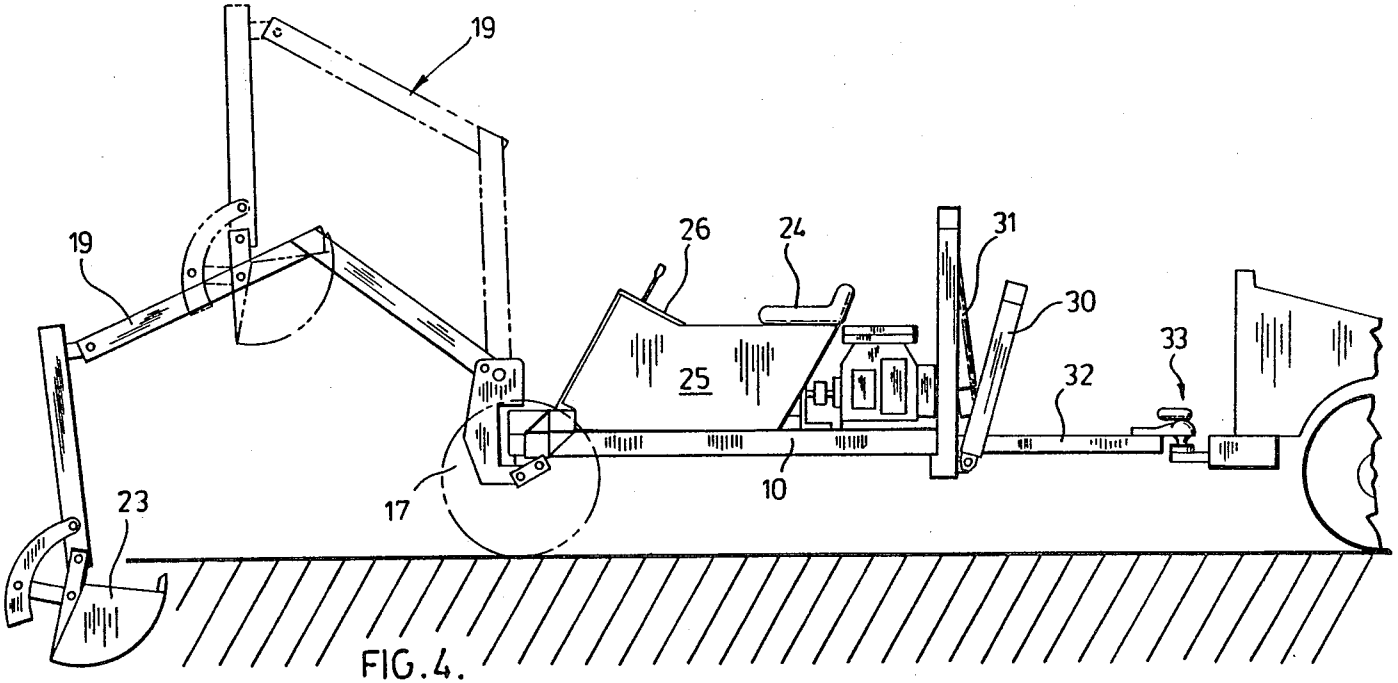
FIG. 4 is a side view of the digger, when coupled to a towing vehicle and in a still further digging mode.

Referring now to FIG. 1 of the drawings, there is shown in plan view a mechanical digger but with the digging device omitted; however, the latter is shown in FIGS. 2 to 4, and comprises a "back-acter" composed of a pivotal bucket/shovel mounted at the end of ram-operated linkages, all in a manner well known in the art.

The digger has a main frame 10, which is shown only schematically in FIG. 1, and which provides support for a seat on which an operator can sit with his legs astride a body mounted on the frame in order to view, and to control, the operation of the digging device. The frame 10 is provided with a front mounting location 11, an intermediate mounting location 12 and a rear mounting location 13. The mounting locations are of identical construction and each comprise hollow, square section tubes 14 which extend transversely of the longitudinal axis of the digger and are provided with projecting stubs 15. At the front mounting location 11, the projecting stubs serve to mount either front ground engaging feet 16 or respective wheels 17 of a wheel set provided for the digger. The intermediate mounting location 12 serves to mount, when required, the wheels 17 of the wheel set. The different modes of operation of the digger will be described in more detail below with reference to FIGS. 2 to 4 of the drawings.

Referring now to FIG. 2 of the drawings, the digger is illustrated with a back-acter 19 which is mounted at the front end of the frame 10 and comprises a pivotal link 20 mounted at the front end of the frame 10, an intermediate link 21 and a final link 22 at one end of which a bucket/shovel 23 is pivotally mounted. Hydraulic or other rams (not shown) are provided to enable appropriate manipulation of the movements of the bucket 23.

There is also shown in FIG. 2 a seat 24 on which an operator can sit with his legs astride a body 25 mounted on the frame 10. A control panel 26 is provided at which control can be exercised oer the operation of the bucket 23. A motor-driven hydraulic unit 27 is mounted on the frame 10 to operate the back-acter 19.

As shown in FIG. 2, front feet 16 are mounted at the front location 11 and rear feet 18 are mounted at the intermediate location 12. The front feet 16 have flat ground pads 28, whereas the rear feet 18 have downwardly projecting "spades" 29 which can dig into the ground to provide positive engagement. In the operating mode shown in FIG. 2, the wheels 17 of the wheel set are mounted at the rear mounting location 13. The wheels 17 are mounted at the end of a pivoted frame portion 30 which is connected to the remainder of the frame 10 at the intermediate location 12 and which is upwardly and downwardly adjustable about an axis parallel to the axis of the wheels 17 by means of the ram 31. In the position illustrated in FIG. 2, the wheels 17 have been adjusted downwardly into engagement with the ground surface.

As shown in FIG. 2, the bucket 23 has been pivoted to a position suitable for operation as a shovel and the spades 29 of the rear feet 18 have been turned to give back pressure support during shovelling. If desired, the rear feet 18 may be turned through 180° to provide reverse ground engagement by the spades 29. The wheels 17 are illustrated in a balance positon in which they can counter-balance, to some extent, the forward loading provided on the frame 10 by the back-acter 19. The front feet 16 are mounted at front location 11 for both normal and shovelling modes of the back-acter. Reversal of the bucket 23 from the shovelling position will enable the bucket to operate in a normal digging mode.

Referring now to FIG. 3, the digger is shown in a normal digging mode. The digger configuration is generally similar to that illustrated in FIG. 2, apart from the spades 27 being reversed, and also the back-acter being adjusted so that the bucket 23 can operate in a digging mode.

Referring now to FIG. 4 of the drawings, the digger is illustrated coupled-up with a towing vehicle. In the position of the back-acter 19 shown in dashed outline in FIG. 4, the digger is in a transport mode whereby it can be readily towed from one site to another by means of a towing vehicle. To enable the digger to be coupled-up with a towing vehicle, a detachable draw bar 32 is provided which is detachably mounted in the frame 10. The coupling with the towing vehicle may be by means of a conventional ball and socket type coupling 33.

The back-acter 19 is also illustrated in full lines in FIG. 4 in a further digging mode of the digger. It is a considerable advantage of the digger, as illustrated, that it can be operated satisfactorily while it is coupled-up to a towing vehicle. It will be noted that the wheels 17 are mounted at the front location 11 and neither the front feet 16, nor the rear feet 18, are mounted on the frame 10. Furthermore, the frame portion 30 is pivoted upwardly out of the way.

In the towing position of the wheels 17, as illustrated, which is also a position for the digging mode of the digger, the wheels are located substantially at the point of balance of the digger. This enable the digger readily to be towed, or operated in a digging or shovelling mode without requiring the use of the front feet 16 or the rear feet 18. The back-acter 19 can be locked in the transport mode by the use of a locking pin which is removed so that the back-acter can move to the digging position.

Returning again to FIG. 1, it will be noted that the front feet 16 provide substantial lateral stability to the digger as a whole, since they extend the width of the digger appreciably relative to the width of the frame. Furthermore when the wheel 17 are mounted at either the front location 11 or the rear location 13, they also provide a wheel base which is up to twice the width of the the frame. To achieve this wheel base, the wheels 17 are mounted at the end of projecting stubs 34 which are mounted on the stubs 15.

Figure 5:
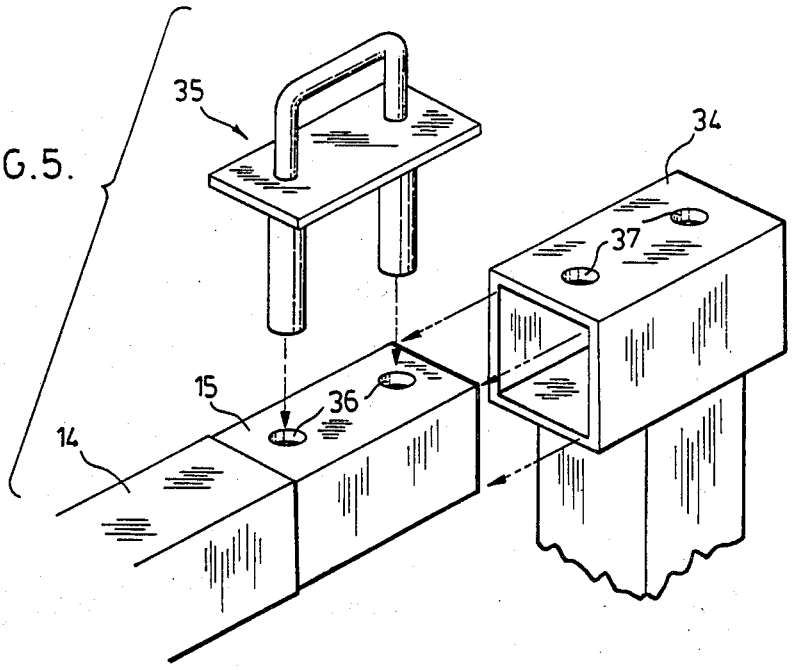
FIG. 5 is a detailed view of a mounting location provided on the frame of the digger at which ground engaging feet or a wheel set may be replaceably mounted.

Referring to FIG. 5, this illustrates the manner by which one of the feet 16 or 18, or one of the wheels 17, may be mounted at one of the mounting locations. The item to be mounted on stub 15, namely one of feet 16, 18 or wheel 17, is provided with square section mounting tube 34 which can be slid onto stub 15 and secured in position by means of locking pin 35 which enters the holes 36 and 37 in stub 15 and tube 34 respectively, when they are aligned.

Figure 6:
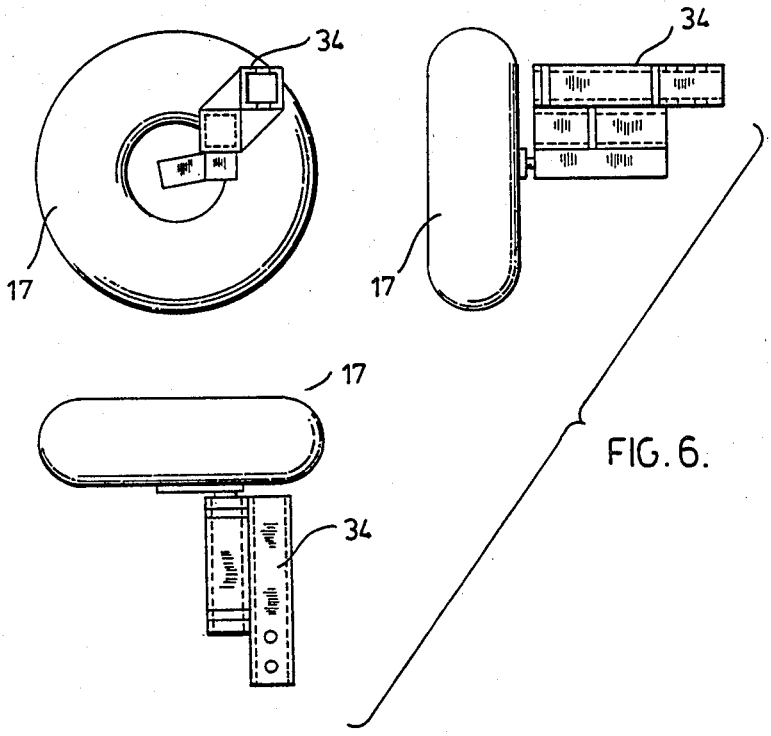
FIG. 6 is a detailed view of a detachable wheel for mounting on the frame of the digger.

Referring to FIG. 6, this illustrates in more detail the construction of the suspension unit and box section provided for each wheel 17, to enable the latter to be mounted at front mounting location 11 or rear mounting location 13.

Figure 7:
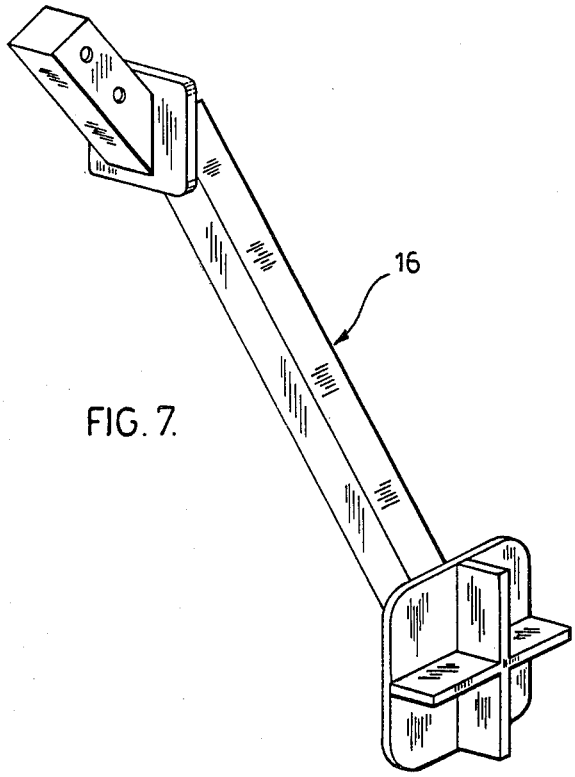
FIG. 7 is a detailed view of front ground engaging feet for the digger.

In FIG. 7, there is illustrated in more detail the construction of the front feet 16 whereby they may be replaceably mounted at front mounting location 11.

Figure 8:
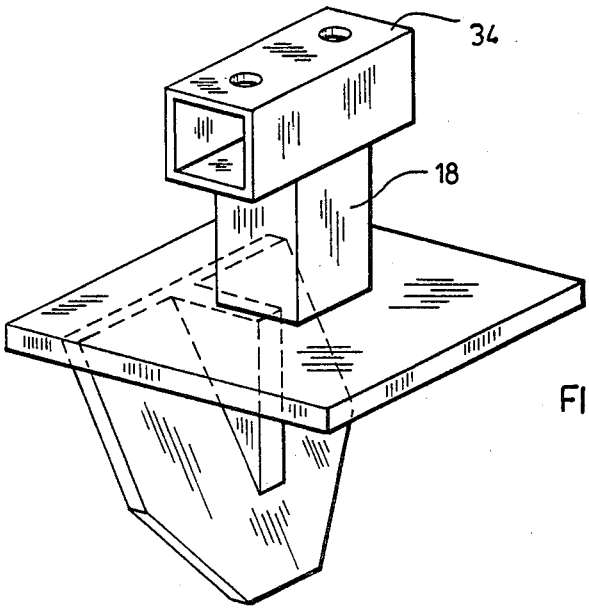
FIG. 8 is a detailed view of a rear ground enaging foot for mounting on the frame of the digger.

In FIG. 8, there is illustrated, similarly, the rear feet 18 and the manner in which they can be mounted replaceably at intermediate mounting location 12.

I claim:

1. A mechanical digger adapted for use in excavation comprising:

a frame having a forward end, a rearward end and a middle portion located between said forward and rearward ends;

conrollable digging means mounted on said frame forward end for excavating;

front end support feet for supporting said frame forward end above ground;

middle support means for supporting said frame middle portion above ground;

wheel means mountable on said frame for supporting said frame above ground;

means for alternately and selectively mounting said front support feet or said wheel means to said frame forward end and wherein said frame rearward end includes wheel mounting means which cooperate with said front end mounting means to provide inerchangable mounting of said wheel means between said frame forward end and said frame rearward end, said front support feet being selectively mounted to said frame forward end during excavation operations and said wheel means being selectively mounted to said frame forward end for towing transportation of said digger by a towing vehicle and excavation operations when said digger is attached to said towing vehicle; and means for raising and lowering the frame rearward end relative said frame middle and front to thereby raise said middle support means out of contact with the ground when said wheel means are mounted to said frame rearward end to allow digging means assisted movement of said digger on said wheel means during excavation.

2. A mechanical digger according to claim 1 wherein said middle support means includes removable middle support feet.

3. A mechanical digger according to claim 2 wherein said middle support means includes a middle stub projecting transversely from said frame middle portion and a mounting tube located on said middle support feet, said mounting tube being slidable onto said middle stub for mounting said middle support feet to said frame, said middle support means further including locking means for securing said rear stub to said mounting tube.

4. A mechanical digger according to claim 2 wherein said middle suppo4rt feet are spade like in shape to penetrate the ground to give added support during excavation.

5. A mechanical digger according to claim 4 wherein said spade like middle support feet are pivotal through 180° to provide for reverse ground engagement during excavation.

6. A mechanical digger according to claim 1 wherein said front and mounting means includes front stubs projecting transversely from said frame forward end and mounting tubes located on said front support feet and wheel means, said mounting tubes being slidable onto said front stub for mounting said front support feet or wheel means to said frame, said front end mounting means further including locking means for securing said front stub to said mounting tubes.

7. A mechanical digger according to claim 6 wherein said wheel mounting means for mounting said wheel means to said frame rearward end includes a rear stub extending transversely from said frame for slidably receiving said wheel means mounting tube, said wheel mounting means further including locking means which removably passes through said wheel means mounting tube and rear stub for securing said rear stub to said mounting tube.

8. A mechanical digger according to claim 1 wherein said front support feet are splayed outward from said frame forward end.

9. A mechanical digger according to claim 1 wherein means for raising and lowering said frame rearward end includes hinge means for hingedly attaching said rearward frame end to said middle frame portion.

10. A mechanical digger according to claim 1 wherein hydraulic means are provided for hydraulicaly raising and lowering said rearward frame end.

11. A mechanical digger according to claim 1 further including tow bar means connectable between said digger rearward end and a tow vehicle for towing transport of and excavation with said mechanical digger when said wheel means are mounted to said frame forward end.

12. A mechanical digger adapted fo use in excavation comprising:

a frame having a forward end, a rearward end and a middle portion located between said forward and rearward ends;

conrollable digging means mounted to said frame forward end for excavating;

means for removably connecting said frame rearward end to a tow vehicle for transportation of said digger and excavating;

front end support feet for supporting said frame forward end above ground during excavation with said digger;

wheel means for supporting said frame forward end above ground during transporting of said digger and excavation with said digger when said digger is connected to said tow vehicle and for supporting said frame rearward end when said front end support feet are mounted to said frame forward end during excavation.

means for alternately mounting said wheel means or said front support feet to said frame forward end;

middle support feet for supporting said middle portion above ground;

means for mounting said middle support feet to said frame middle portion;

means for removably mounting said wheel means to said frame rearward end said rearward end mounting means cooperating with said forward end mounting means to provide alternate removable mounting of said wheel means to said frame forward or rearward end; and means for raising and lowering said frame rearward end means for raising and lowering said frame rearward end relative said frame middle portion to thereby raise said middle feet above the ground to allow movement of said digger on said wheel means mounted to said rearward end during excavation.

13. A mechanical digger according to claim 12 wherein said controllable digging means includes motor driven hydraulic power means mounted on said frame middle portion for operating said digging means.

14. A mechanical digger according to claim 12 including seat means located near said frame middle portion on which an individual may sit to controllably operate said digging means during excavation.

15. A mechanical digger according to claim 12 wherein the center of gravity of said digger is close to said forward frame end.

16. A mechanical digger adapted for use in excavation comprising:

a frame having a forward end, a rearward end and a middle portion located between said forward and rearward ends;

front support feet for supporting the frame forward end above ground, said front support feet including a first end for contacting the ground and a second end;

front mounting receptacles located at the frame forward end;

means located on said front support feet second end for removably mounting said front support feet to said front mounting receptacles;

middle support feet for supporting the frame middle portion above ground;

means for mounting said middle support feet to said frame middle portion;

digging means mounted on said frame foward end for excavating while said frame is supported on the spaced front end support feet and middle support feet;

support wheels;

rear mounting receptacles located at the frame rearward end and adapted to removably receive said support wheels for mounting to the frame rearward end;

means for raising and lowering the frame rearward end relative said frame middle portion to thereby place the support wheels on the ground to support said frame and raise said middle support means out of contact with the ground to allow digging means assisted movement of said digger on said wheels; and means located on said support wheels for interchangeable mounting of said support wheels to said rear mounting receptacles or said front mounting receptacles, wherein said support wheels may be removed from said rear mounting receptacles and mounted to said front mounting recptacles in place of said front support feet to allow towing of said digger by a tow vehicle or excavation operations while said digger is connected to said tow vehicle.

17. A mechanical digger according to claim 16 including a receptacle located rearward of said frame front end for removably mounting a tow bar for connecting said digger to a tow vehicle or providing for manual movement of said digger using said tow bar when said support wheels are mounted to said front mounting receptacles.

18. A mechanical digger according to claim 17 wherein the center of gravity of said digger is close to said forward rame end to minimize vertical loading on said tow bar.

19. A mechanical digger according to claim 18 wherein said means for mounting said middle support feet includes stubs located at either end of said rear cross bar on said center piece.

20. A mechanical digger according to claim 18 wherein said rear piece includes two spaced parallel members.

21. A mechanical digger according to claim 18 wherein said frame includes tow bar receptacle means located on said rear crossbar for removably receiving a tow bar.

22. A mechanical digger according to claim 16 wherein said frame includes:

a center piece having a front end and a rear end;

a front cross bar mounted transversely on the center piece front end and having stubs on each end forming said front mounting receptacles;

a rear cross bar mounted transversely on said center piece rear end; and a rear piece having a front end and a rear end;

means for attaching said rear piece front end to said rear cross bar; and a cross bar mounted transversely on said rear piece and having stubs on each end forming said rear mounting receptacles.

23. A mechanical digger according to claim 22 wherein said digging means includes motor driven hydraulic power means mounted to said center piece adjacent said rear crossbar for operating said digging means.

24. A mechanical digger according to claim 23 including seat means located above said power means on which an individual may sit to controllably operate said digging means.

25. A mechanical digger according to claim 24 including a control console located between said seat means and said digging means.

26. A mechanical digger adapted for use in excavation comprising:

a frame having a forward end and a rearward end;

front support feet for supporting the frame forward end, said front support feet including a first end for contacting the ground and a second end;

controllable digging means mounted to said frame forward end for excavating;

front mounting receptacles located at the frame forward end;

means located on said front end support feet second end for removably mounting said front end support feet to said front mounting receptacles;

support wheels;

rear mounting receptacles located at the frame rearward end and adapted to removably receive said support wheels for mounting to the frame rearward end;

means located on said support wheels for interchangeably mounting said support wheels to said rear mounting receptacles or said front mounting receptacles;

means for supporting said frame rearward end from a tow vehicle when said support wheels are mounted to said front mounting receptacles for transportation of said digger or excavation, said rearward end support means being disengageable when said support wheels are mounted to said rearward receptacles to thereby allow support of said frame upon the spaced support wheels and front support feet.

* * * * *